US008146785B2

(12) United States Patent
Pruitt

(10) Patent No.: US 8,146,785 B2
(45) Date of Patent: Apr. 3, 2012

(54) TOOL RETAINING APPARATUS

(76) Inventor: George E. Pruitt, Ellisville, MO (US)

( * ) Notice: Subject to any disclaimer, the term of this patent is extended or adjusted under 35 U.S.C. 154(b) by 558 days.

(21) Appl. No.: 12/264,452

(22) Filed: Nov. 4, 2008

(65) Prior Publication Data

US 2009/0127302 A1 May 21, 2009

Related U.S. Application Data

(60) Provisional application No. 60/986,090, filed on Nov. 7, 2007.

(51) Int. Cl.
*A44C 5/00* (2006.01)

(52) U.S. Cl. ..... 224/219; 224/661; 24/3.2

(58) Field of Classification Search ..... 224/218, 224/219, 661; 24/3.2
See application file for complete search history.

(56) References Cited

U.S. PATENT DOCUMENTS 4,041,562 A * 8/1977 Nealy ..... 441/75
4,315,641 A * 2/1982 Larsen ..... 280/822
4,958,758 A * 9/1990 Tipple et al. ..... 224/267
5,130,899 A * 7/1992 Larkin et al. ..... 362/570
5,472,125 A * 12/1995 Barnard ..... 224/219
5,600,873 A * 2/1997 May ..... 24/3.2
5,697,572 A 12/1997 Salentine et al.
6,216,319 B1 4/2001 Elkins
6,568,574 B2 * 5/2003 Jones et al. ..... 224/222
6,752,305 B2 * 6/2004 Shattuck ..... 224/603
6,966,519 B2 11/2005 Salentine et al.
2003/0106920 A1 * 6/2003 Sagan ..... 224/578
2007/0095870 A1 * 5/2007 Griffith et al. ..... 224/219

OTHER PUBLICATIONS

Gear Keeper, Heavy Tool Tethers, http://www.gearkeeper.com/tooltethers/tooltethers.html, Dec. 10, 2008, 5 pages.

* cited by examiner

*Primary Examiner* — Brian D Nash
(74) *Attorney, Agent, or Firm* — Lathrop & Gage LLP

(57) ABSTRACT

An apparatus for tethering tool(s) to a worker, object, support or the like, allows single or multiple tools to remain in close proximity to the worker for easy access and use. The tool(s) remain secured, so as not to fall out of the worker's range or fall to a point where the tools become lost.

6 Claims, 3 Drawing Sheets

TOOL RETAINING APPARATUS

RELATED APPLICATIONS

This application is related to and claims priority from commonly owned U.S. Provisional Patent Application Ser. No. 60/986,090, entitled: Tool Retaining Apparatus, filed Nov. 7, 2007, the disclosure of which is incorporated by reference herein.

TECHNICAL FIELD

The present disclosed subject matter is directed to mechanisms that allow tools and other instruments to be held safely and securely and in proximity to the operator.

BACKGROUND

When a worker is working on a job, they typically use multiple tools and switch between these multiple tools contemporaneously. This involves placing the tool they have finished using down in close proximity to where they are working, picking up another proximately placed tool, and repeating this process with the same or another tool. This may not be possible if the worker is elevated, such as on a ladder, stool, or the like, or there is not a surface proximate the work area where the tool or tools can be placed.

Additionally, should the worker be working over water or at great heights, the tools can be knocked off of a surface on which they rest and become lost, or if at great heights, create a safety hazard from a falling tool. This results in substantial time being spent in recovering tools as well as switching tools, leading to additional costs associated with a job.

SUMMARY

The present disclosed subject matter overcomes the problems of working with multiple tools that must be used contemporaneous with each other at short intervals or a single tool used at close intervals. The tool or tools remain in close proximity to the worker for easy access and use and remain secured, so as not to fall out of the worker's range or fall to a point where the tools become lost (and must be replaced).

The disclosed subject matter includes an apparatus for tethering tool(s) to a worker, object, support or the like, allowing for single or multiple tools to remain in close proximity to the worker for easy access and use. The apparatus keeps the tool(s) secured, so as not to fall out of the worker's range or fall to a point where the tools become lost.

The disclosed subject matter is directed to an apparatus for holding a tool. The apparatus includes a main body with a flexible portion and oppositely disposed first and second ends. There is a first holder at the first end of the main body and a second holder at the second end of the main body. Each of the first and second holders includes a strap that is foldable over itself to retain at least one object, such as a human wrist, tool or the like, and is self engaging to define a ring for attaching to a structure.

Another embodiment is directed to an apparatus for holding a tool, that includes a flexible member, for example, a flexible cord, including oppositely disposed first and second ends, a first holder coupled to the first end of the flexible member and a second holder coupled to the second end of the flexible member. The first holder includes a strap that is self-engaging to attach to or retain at least one object, and the second holder includes at least one structure for attaching to at least one object. The second holder may be, for example, a strap, that is self-engaging, to attach to or retain at least one object, or a ring-like or ring element. Both straps may, for example, include ring members, allowing the straps to be foldable over themselves, and may have sections of cooperating material that when brought together engage each other (for example, hook material and loop material).

Another embodiment is directed to a method for securing a tool within an area proximate to a worker. The method initially includes providing an apparatus for holding a tool, including a flexible member including oppositely disposed first and second ends, a first holder at the first end of the flexible member and a second holder at the second end of the flexible member. The first holder includes a strap that is self-engaging to attach to or retain at least one object, and the second holder includes at least one structure for attaching to at least one object. The second holder is attached to at least one tool, for example, a drill, screwdriver or the like, and the first holder is attached to another object, for example, the arm (at the wrist) of a worker or user, or the clothing of the worker.

BRIEF DESCRIPTION OF THE DRAWINGS

Attention is now directed to the drawing figures, where like or corresponding numerals or characters indicate corresponding or like components. In the drawings.

DETAILED DESCRIPTION

Figure 1:
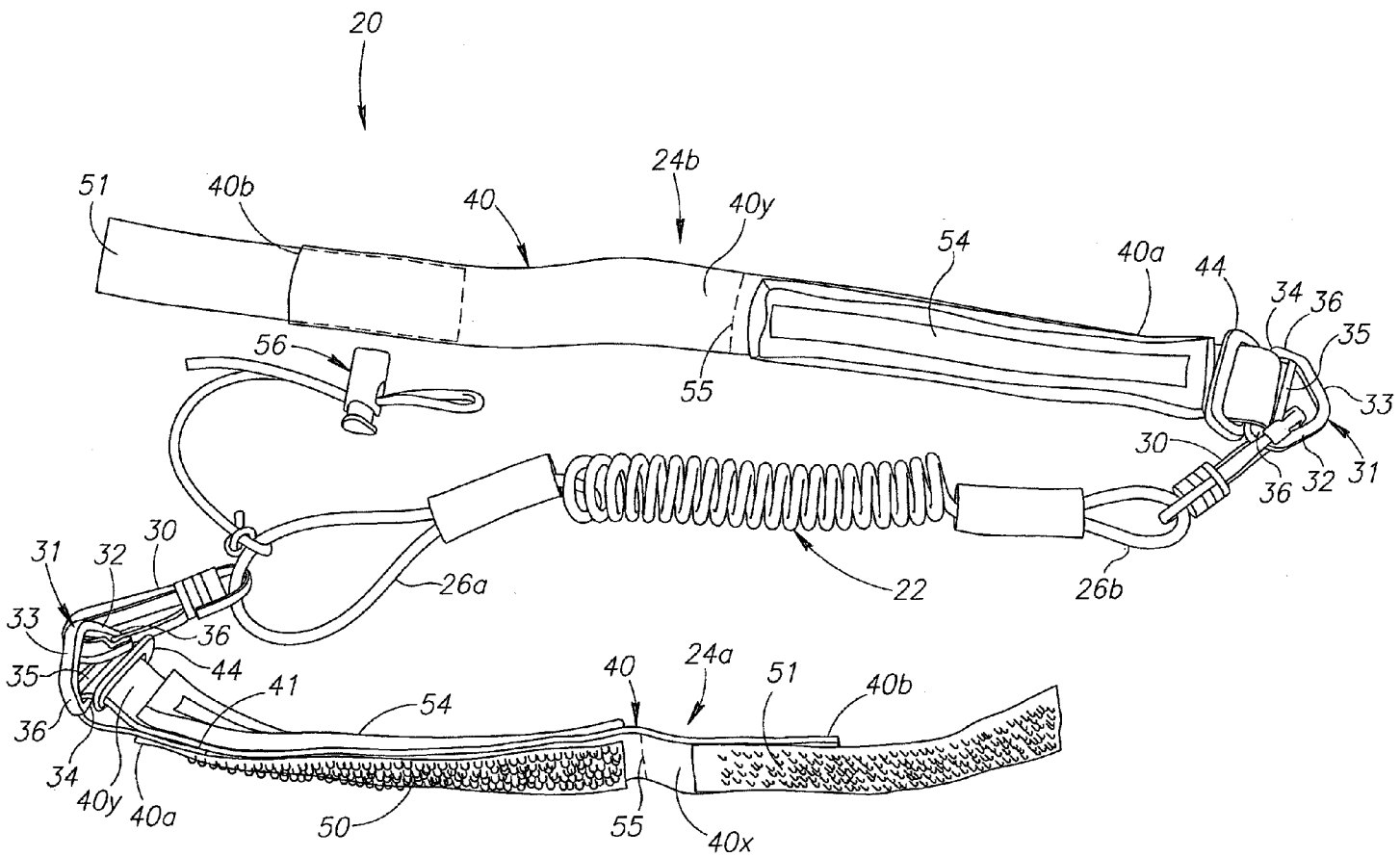
FIG. 1 is a perspective view of an apparatus in accordance with the disclosed subject matter; and, FIGS. 2 and 3 are diagrams of the apparatus of FIG. 1 in exemplary operations.

FIG. 1 shows the apparatus 20 without tools. The apparatus 20 includes a main body 22 intermediate to attachment portions or holders 24*a*, 24*b*, for example, attached at opposite ends 22*a*, 22*b* of the main body 22. The attachment portions 24*a*, 24*b* may be of configurations to support attachment to a user, or other stable structure, or for attaching to and holding tools.

The main body 22 is, for example, a flexible member. For example, it is a flexible wire or wires, cord, or the like, plastic or rubber coated, similar to that of a conventional telephone cord. The main body is configured, so as to allow for expansion, giving the worker a wide span for access to the tool or tools held in the opposite attachment portion.

Each attachment portion 24*a*, 24*b* attaches to the main body 22, for example, with a range of motion. The attachment is, for example, with a clip 30, for example, joined to the main body 22 at loops 26*a*, 26*b*. The loops 26*a*, 26*b* are at the ends 22*a*, 22*b* of the main body 22.

Each clip 30 attaches to a clip receiving structure 31, on each of the attachment portions 24*a*, 24*b*. The clip receiving structure 31 is formed of an outer ring 32, for example, including a V-shaped end 33 and a straight end 34, with an inner cross member 35, extending between the sides 36 of the ring 32.

A belt or strap 40, for example, a strip of a nylon material, is attached to the clip receiving structure 31. For example, this attachment is by a portion 41 of the belt 40 being folded over the remainder of the belt 40 around the straight end 34 (and before the cross-member 35). The folded over portion 41 is affixed to the remainder of the belt 40 by fasteners, such as stitches, adhesives and the like. This attachment is at a first end 40*a* of the belt 40.

There is an area 42 formed by the folded over portion 41 that is not affixed to the remainder of the belt 40. An adjustment ring 44 is slideable in this area 42, as a portion of the belt 40 extends through this ring 44.

The belt 40 extends from the clip receiving structure 31, at a first end 40*a* to an opposite second end 40*b* and includes opposite sides 40*x* and 40*y*. A first side 40*x* includes a strip of loop material 50 or other fastening material. The strip of loop material 50 extends from the end 40*a* of the belt inward, and may be fastened to the belt 40 by fasteners such as such as stitches, adhesives and the like.

The first side 40*x* also includes a strip of hook material 51 or other fastening material. The strip of hook material 51 is at the end 40*b* of the belt 40 and may extend beyond the belt 40. The strip of hook material 51 may be fastened to the belt 40 by fasteners such as such as stitches, adhesives and the like.

The loop material and the hook material are designed to engage each other when brought into contact and hold in place, until manually disengaged. For example, one type of corresponding hook material and loop material that may be used is VELCRO®. Alternately, the positions on the belt 40 of the strip of loop material 50 and strip of hook material 51 may be reversed.

The opposite side 40*y* of the belt 40 proximate the end 40*a* may include a portion of soft material 54, for example, rubber, sponge, or the like. The portion of soft material 54 prevents the belt material from rubbing against the skin of the user. The portion of soft material 54 may be fastened to the belt 40 by fasteners such as stitches, adhesives and the like. The belt 40 may also be pre-creased, for example, as shown by the broken lines 55, allowing its strips of loop 50 and hook 51 material to be mated for storage.

One or both ends of the apparatus 20 may include sub holders 56, for example, ring-like elements, for additional attachment to tools or other structures. These sub holders 56 may, for example, attach at the respective loops 26*a*, 26*b*, and they may be hold a string or wire by being spring biased.

Figure 2:
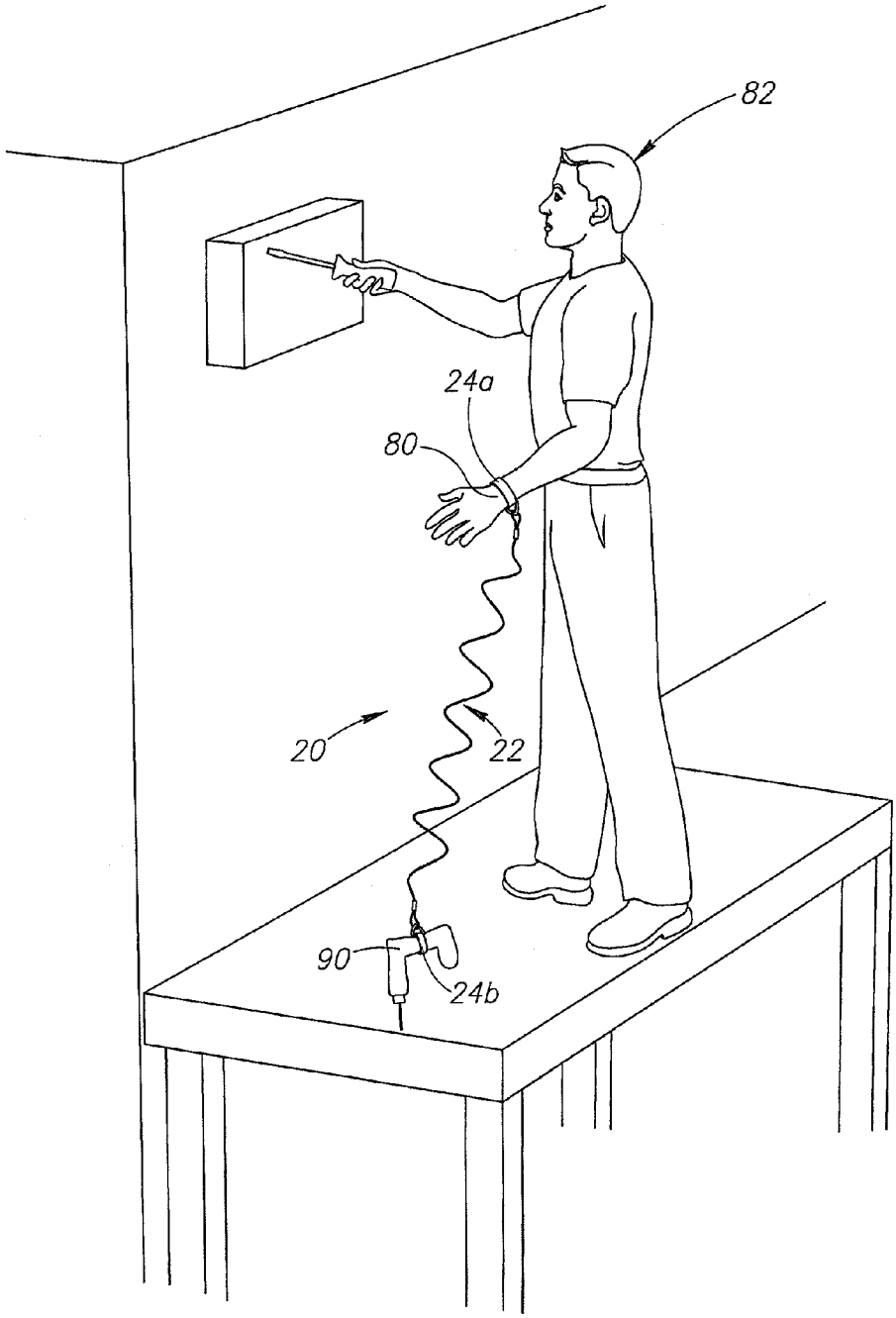

FIG. 2 shows the apparatus in an exemplary operation. One attachment portion 24*a*, is attached to the arm, for example, at the wrist 80 of a worker 82. The other attachment portion 24*b* is holding tools, for example, a drill 90. While a single tool is shown held, multiple tools may be held by the attachment portion 24*b* in the same manner. The tool, e.g., the drill 90, rests on a platform tethered to the worker 82, allowing the worker 82 easy, convenient and rapid access to the tool.

The attachment portion 24*a* attaches to the wrist 80 as the portion of soft material 54 is placed facing the wrist 80. The belt 40 is placed through the adjustment ring 44, wrapped around the wrist 80, and once secure around the wrist 80, the end 40*b* is folded over at the ring 44. The end 40*b* of the belt 40 is moved into contact with the belt 40, such that the strip of loop material 50 engages the strip of hook material 51, forming a closed loop around the wrist 80.

The attachment portion 24*b*, as shown attaches to a tool, e.g., the drill 90, by being frictionally engaged in a closed loop, similar to that detailed above for the attachment portion 24*a*. Alternately, the tool, e.g., the drill 90 could be engaged between the folded over ends 40*a*, 40*b* of the belt 40, as portions of the strip of loop material 50 would engage portions of the strip of hook material 51.

Figure 3:
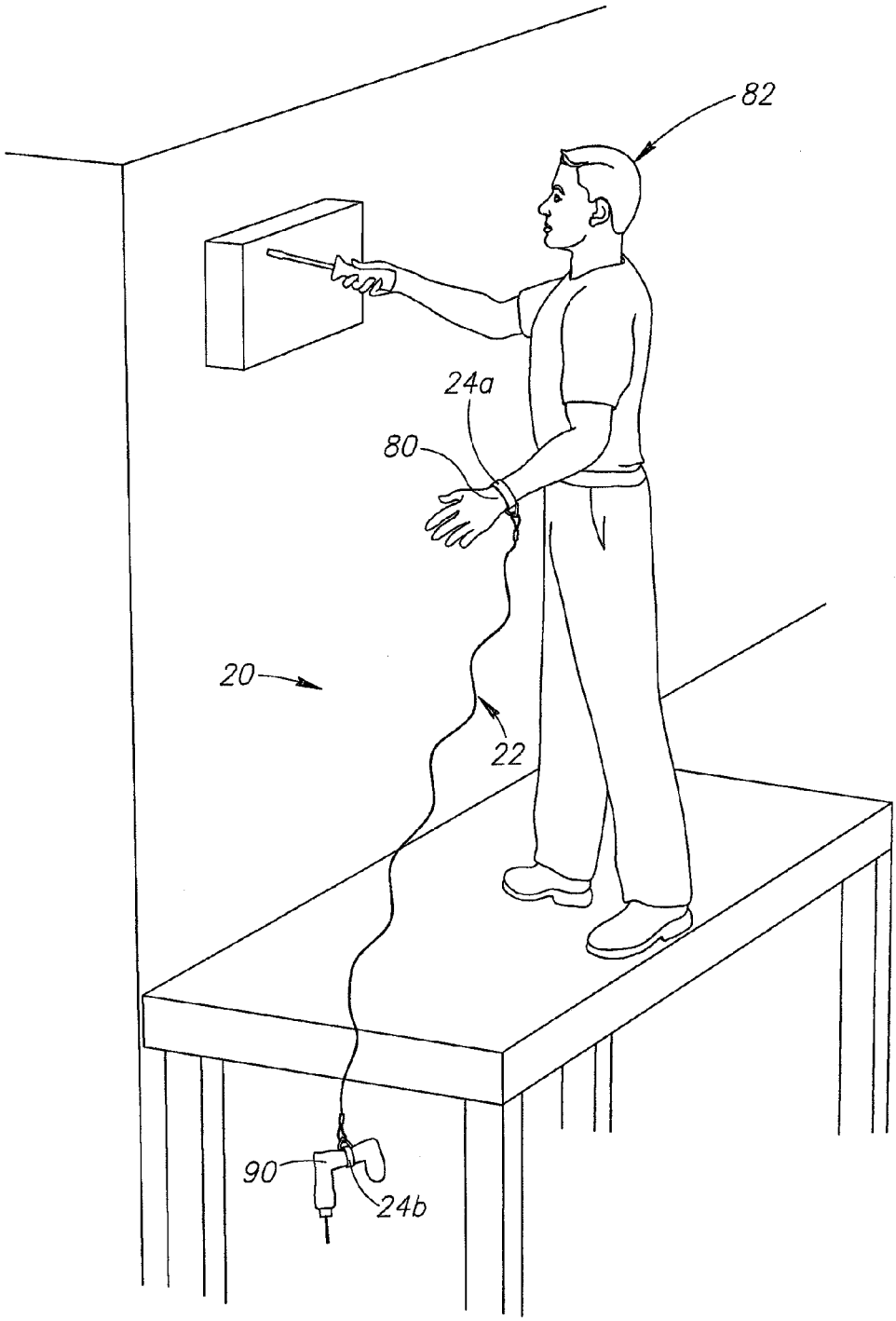

FIG. 3 shows another operation, where a worker 82 is elevated. The tool, e.g., the drill 90, engaged in the attachment portion 24*b*, has fallen from the worker's hand, and off of the platform on which the worker 82 is working. However, the worker 82 remains in control of the tool, e.g., the drill 90, by virtue of its being held by the apparatus 20. The tool, e.g., the drill 90, has not fallen out of the work area or become lost, as it remains tethered to the worker 82.

While preferred embodiments of the present disclosed subject matter have been described, so as to enable one of skill in the art to practice the present disclosed subject matter, the preceding description is intended to be exemplary only. It should not be used to limit the scope of the disclosed subject matter, which should be determined by reference to the following claims.

What is claimed is:

1. An apparatus for holding a tool comprising:

a) a coiled cord having oppositely disposed first and second ends, a first loop, and a second loop; the first loop being coupled to the first end and the second loop being coupled to the second end;

b) a first clip and a second clip;

c) a first clip receiving structure comprising a V-shaped end, a straight end, and an inner cross member;

d) a second clip receiving structure comprising a V-shaped end, a straight end, and an inner cross member;

e) a first attachment member folded over the straight end of the first clip receiving structure, the first attachment member having a first side and a second side and a proximal end and a distal end, the first side of the first attachment member including a soft portion, and the second side of the first attachment member comprising a first portion commencing adjacent the proximal end of the first attachment member and a second portion commencing adjacent the distal end of the first attachment member, the first and second portions of the second side of the first attachment member being configured to removably engage with each other upon contact;

f) a second attachment member folded over the straight end of the second clip receiving structure, the second attachment member having a first side and a second side and a proximal end and a distal end, the first side of the second attachment member including a soft portion, and the second side of the second attachment member comprising a first portion commencing adjacent the proximal end of the second attachment member and a second portion commencing adjacent the distal end of the second attachment member, the first and second portions of the second side of the second attachment member being configured to removably engage with each other upon contact;

wherein the first clip receiving structure is coupled to the first clip and the second clip receiving structure is coupled to the second clip; and wherein the first clip is coupled to the first loop and the second clip is coupled to the second loop.

2. The apparatus of claim 1, further comprising a holder being coupled to one of the first and second loops.

3. The apparatus of claim 2, wherein the coiled cord is a conventional telephone cord.

4. The apparatus of claim 3, wherein the first portion of the first attachment member includes hook fasteners or loop fasteners, and the second portion of the first attachment member includes hook fasteners or loop fasteners; and wherein the first portion of the second attachment member includes hook fasteners or loop fasteners, and the second portion of the second attachment member includes hook fasteners or loop fasteners.

5. The apparatus of claim 4 further comprising a first adjustment ring and a second adjustment ring; and wherein the first attachment member is folded over both the first adjustment ring and the straight end of the first clip receiving structure; and wherein the second attachment member is folded over both the second adjustment ring and the straight end of the second clip receiving structure.

6. The apparatus of claim 5, wherein at least one of the first and second attachment members includes a crease.

* * * * *